US007849794B2

(12) United States Patent
Helmstädter et al.

(10) Patent No.: US 7,849,794 B2
(45) Date of Patent: Dec. 14, 2010

(54) DEVICE FOR TRANSPORTING SHEETS IN STRAIGHT PRINTING OR PERFECTING OPERATION BY WAY OF TONGS GRIPPERS

(75) Inventors: Karl-Heinz Helmstädter, Heidelberg (DE); Olaf Lorenz, Ludwigshafen (DE); Sonja Kaufmann, Eppelheim (DE); Wilhelm Lefken, Dossenheim (DE); Thomas Schmidt, Eppelheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 990 days.

(21) Appl. No.: 11/370,690

(22) Filed: Mar. 8, 2006

(65) Prior Publication Data

US 2006/0201353 A1 Sep. 14, 2006

(30) Foreign Application Priority Data

Mar. 8, 2005 (DE) ..... 10 2005 010 426

(51) Int. Cl.
*B41F 5/02* (2006.01)

(52) U.S. Cl. ..... 101/230; 101/246; 101/409; 271/277

(58) Field of Classification Search ..... 101/229, 101/230, 231, 232, 246, 409, 410; 271/277, 271/314

See application file for complete search history.

(56) References Cited

U.S. PATENT DOCUMENTS

| | | | | |
|---|---|---|---|---|
| 4,101,122 | A * | 7/1978 | Jeschke et al. | 271/277 |
| 6,263,794 | B1 * | 7/2001 | Haupenthal | 101/409 |
| 6,705,227 | B2 * | 3/2004 | Becker | 101/409 |

FOREIGN PATENT DOCUMENTS

| | | | |
|---|---|---|---|
| DE | 24 14 998 | C3 | 10/1975 |
| DE | 25 28 535 | B2 | 1/1977 |
| DE | 38 23 545 | A1 | 2/1989 |
| DE | 100 52 145 | A1 | 5/2001 |
| DE | 102 25 503 | A1 | 1/2004 |
| GB | 21 22 175 | A | 1/1984 |
| JP | 59-85759 | | 5/1984 |
| JP | 2-30533 | | 1/1990 |

* cited by examiner

*Primary Examiner*—Ren Yan
(74) *Attorney, Agent, or Firm*—Laurence A. Greenberg; Werner H. Stemer; Ralph E. Locher

(57) ABSTRACT

A device for transporting sheets in recto or verso printing operation has tongs grippers each with upper and lower grippers. The upper gripper, or rigid gripper, that forms the gripper pad can be locked directly or indirectly in recto printing operation.

12 Claims, 5 Drawing Sheets

DEVICE FOR TRANSPORTING SHEETS IN STRAIGHT PRINTING OR PERFECTING OPERATION BY WAY OF TONGS GRIPPERS

BACKGROUND OF THE INVENTION

Field of the Invention

The invention lies in the printing technology field. More specifically, the invention relates to a device for transporting sheets by way of tongs grippers that can be changed from straight printing (recto printing) to perfecting (recto/verso printing).

A device of that type is known, for example from German patent DE 24 14 998 and its counterpart U.S. Pat. No. 4,101,122. There, a generic device for transporting sheets wherein an upper and lower gripper of a tongs gripper system is in each case controlled by a control cam. The tongs gripper can carry out both a pivoting movement and an opening movement in turning operation. In recto printing operation, the tongs gripper system is controlled by recto printing control cams which are arranged parallel to the turner control cams and which ensure that the upper gripper forms the gripper pad as what is known as a rigid gripper. This measure has the advantage that an adjustment of the gripper pad to different sheet thicknesses can be dispensed with. However, a series of forces distributed over the axial length of the gripper system act on the individual gripper pads arranged beside one another. In particular, mention should also be made here of the torsional forces which, overall, can lead to faulty tolerances with respect to the gripper pad height.

SUMMARY OF THE INVENTION

It is accordingly an object of the invention to provide a device for transporting sheets in recto or recto/verso printing by way of grippers which overcomes the above-mentioned disadvantages of the heretofore-known devices and methods of this general type and which allows minimizing the gripper pad height tolerance, in particular in recto printing operation.

With the foregoing and other objects in view there is provided, in accordance with the invention, a device for transporting sheets, comprising:

a tongs gripper system configured to selectively transport sheets in recto printing operation or in turning operation, the gripper system having a plurality of grippers each with an upper gripper and a lower gripper;

wherein the upper gripper is configured to form a gripper pad in recto printing operation, and the rigid upper gripper is disposed to be locked, directly or indirectly, in recto printing operation.

It is a particular advantage of the invention that the upper grippers functioning as a gripper pad in recto printing operation can be locked and supported, which results in an exactly defined gripper pad height. This permits satisfactory gripping and holding of the sheets and thus ensures fault-free sheet transport.

A preferred embodiment of the locking, which can be implemented very simply, is a supporting bearing arranged between the grippers and having a latching mechanism formed in such a way that it can be brought into operative contact with the gripper shaft. By means of this measure, indirect locking of the gripper system is made possible.

In a second advantageous embodiment, a holding clamp is provided which permits the simultaneous holding of the lower and upper gripper during sheet transport. This measure permits direct locking of the gripper system.

In a third device, a rack system is provided for the indirect locking of the upper gripper and/or of the gripper pad.

Other features which are considered as characteristic for the invention are set forth in the appended claims.

Although the invention is illustrated and described herein as embodied in a device for transporting sheets in recto or verso printing operation by means of tongs grippers provided, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of three specific exemplary embodiments when read in connection with the accompanying drawings.

DESCRIPTION OF THE PREFERRED EMBODIMENTS

Figure 1:
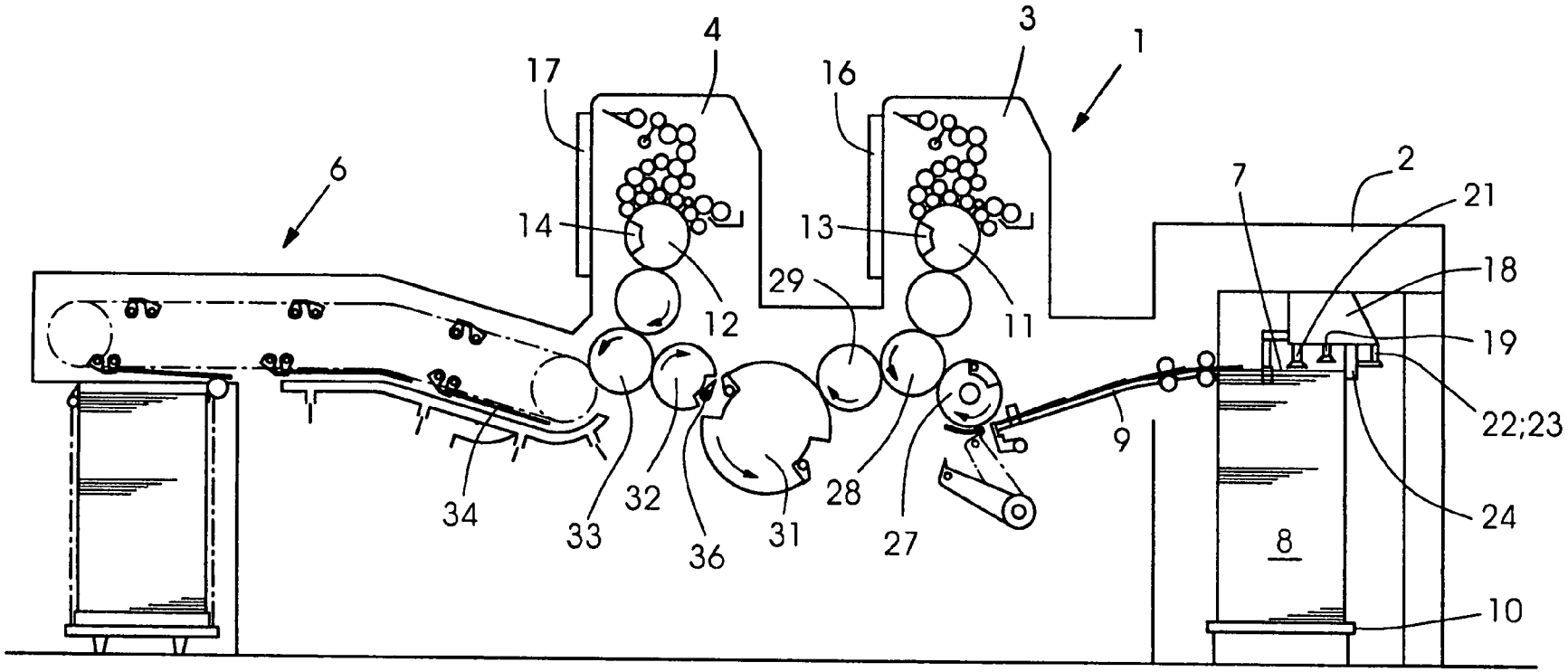
FIG. 1 shows a rotary press in section in a schematic illustration.

Referring now to the figures of the drawing in detail and first, particularly, to FIG. 1 thereof, there is shown a machine processing sheets 7, for example a press 1. The machine has a feeder 2, at least one printing unit 3 and 4 and a delivery 6. The sheets 7 are removed from a sheet stack 8 and, separated or overlapping in imbricated relationship, are fed over a feed table 9 to the printing units 3 and 4. The latter each contain a plate cylinder 11, 12, in a known manner. The plate cylinders 11 and 12 each have an apparatus 13, 14 for fixing flexible printing plates. Furthermore, an apparatus 16, 17 for the semiautomatic or fully automatic printing plate change is assigned to each plate cylinder 11, 12.

The sheet stack 8 lies on a stack board 10 that can be raised under control. The sheets 7 are removed from the top side of the sheet stack 8 by way of a suction head 18, as it is known, which inter alia has a number of lifting and dragging suckers 19, 21 for the separation of the sheets 7. Furthermore, the blowing devices 22 for loosening the upper sheet layers and sensing elements 21 for tracking the stack are provided. In order to align the sheet stack 8, in particular the upper sheets 7 of the sheet stack 8, a number of side and rear stops 24 are provided.

A number of sheet-carrying cylinders 27 to 33 ensure the sheet transport from the feed table 9 through the printing units 3, 4 to the chain delivery system 34. The sheet-transporting cylinder 32 is constructed as a turner drum having at least one tongs gripper system 36. The gripper system 36 is distinguished by the fact that it is able to carry out both an opening and closing movement and also a pivoting movement under cam control in order to turn the sheets. The tongs gripper system 36 comprises a number of upper and lower grippers 38, 37 arranged beside one another and distributed over the axial length of the turner drum 32.

The grippers are carried by a gripper shaft 39, which is arranged in a gripper tube 41 enclosing the gripper shaft 39 coaxially, the upper grippers 38, also designated rigid grippers, being fixed to the gripper shaft 39 and the lower grippers 37 being fixed to the gripper tube 41.

Figure 2:
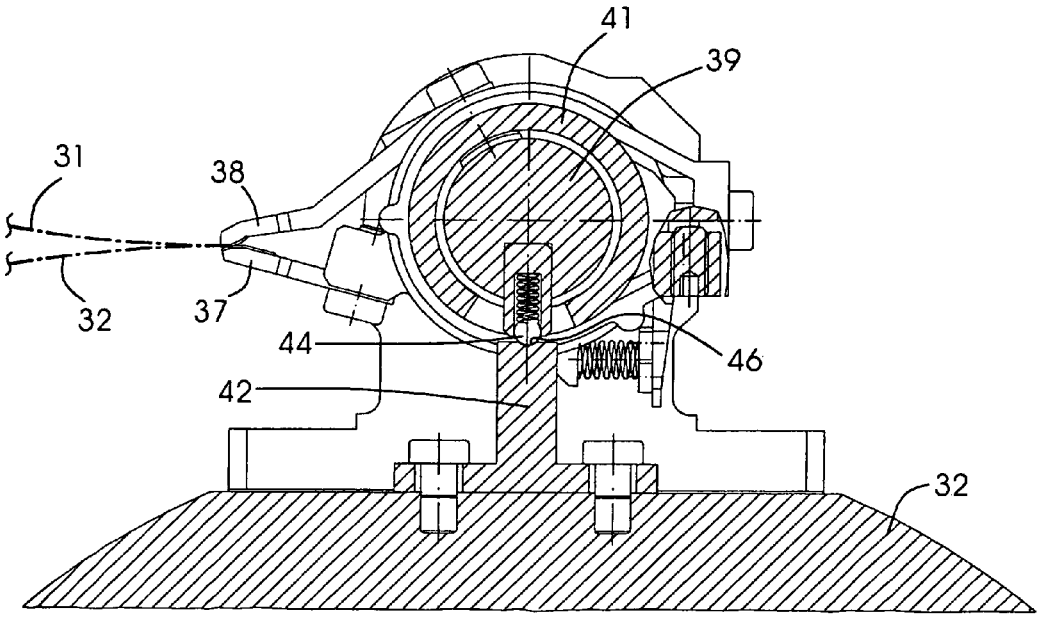
FIG. 2 is a schematic sectional view of a first exemplary embodiment of a locking device, taken along the section line II-II in FIG. 3.
Figure 3:
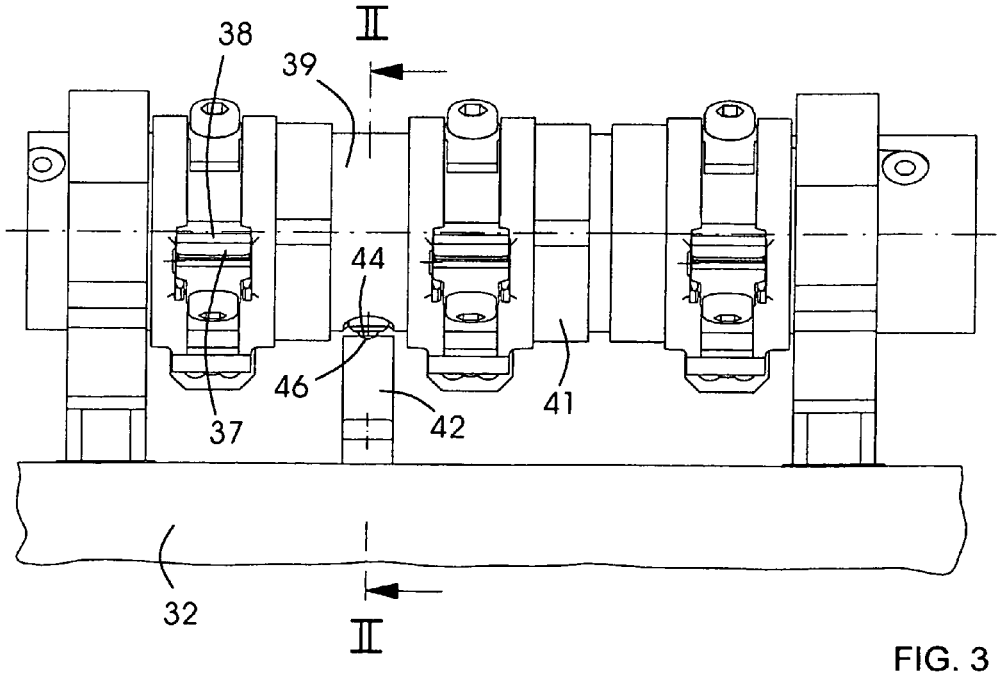
FIG. 3 is a plan view showing the first exemplary embodiment.

In order that the upper grippers 38 are supported sufficiently well during the sheet transport in recto printing operation and, at the same time, are secured against torsional fluctuations, provision is made, according to FIGS. 2 and 3, for the gripper shaft 39 to be locked with respect to the turner drum 32. A plurality of supports 42, fixed to the cylinder body of the turner drum 32, are disposed axially at a distance from one another, such that, between two pairs of grippers 37, 38-37, 38, they can be brought into operative connection with a latching mechanism 43, which is arranged on the gripper shaft 39. The latching mechanism 43 has a spring-loaded ball 44 which corresponds with a receptacle 46 in the support 42. This is an indirect, non-controllable locking means.

Figure 4:
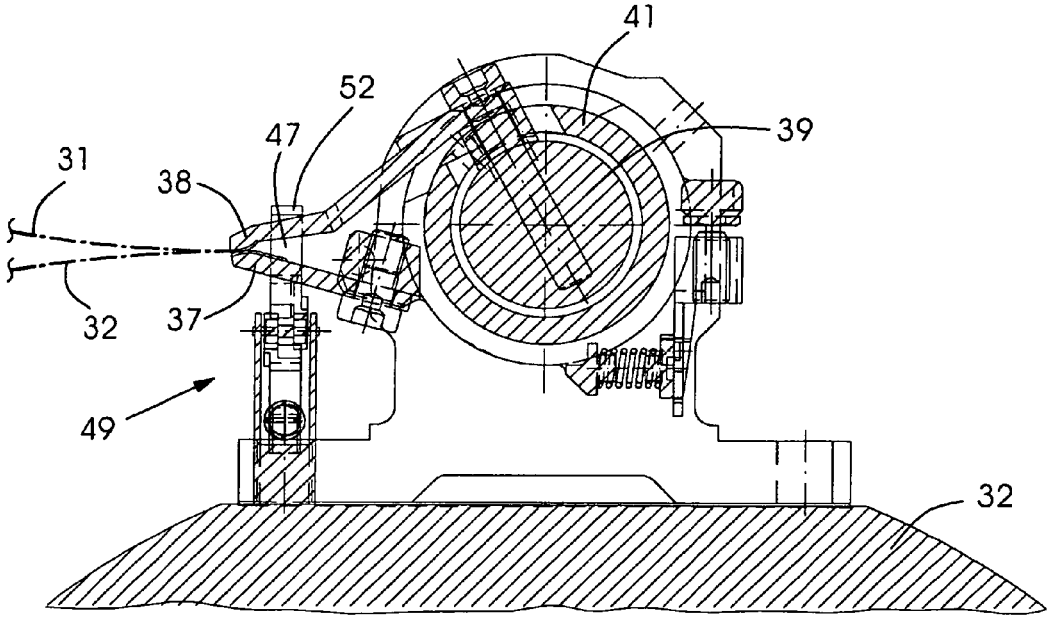
FIG. 4 is a schematic sectional view of a second exemplary embodiment of a locking device, taken along the section line IV-IV in FIG. 5.
Figure 5:
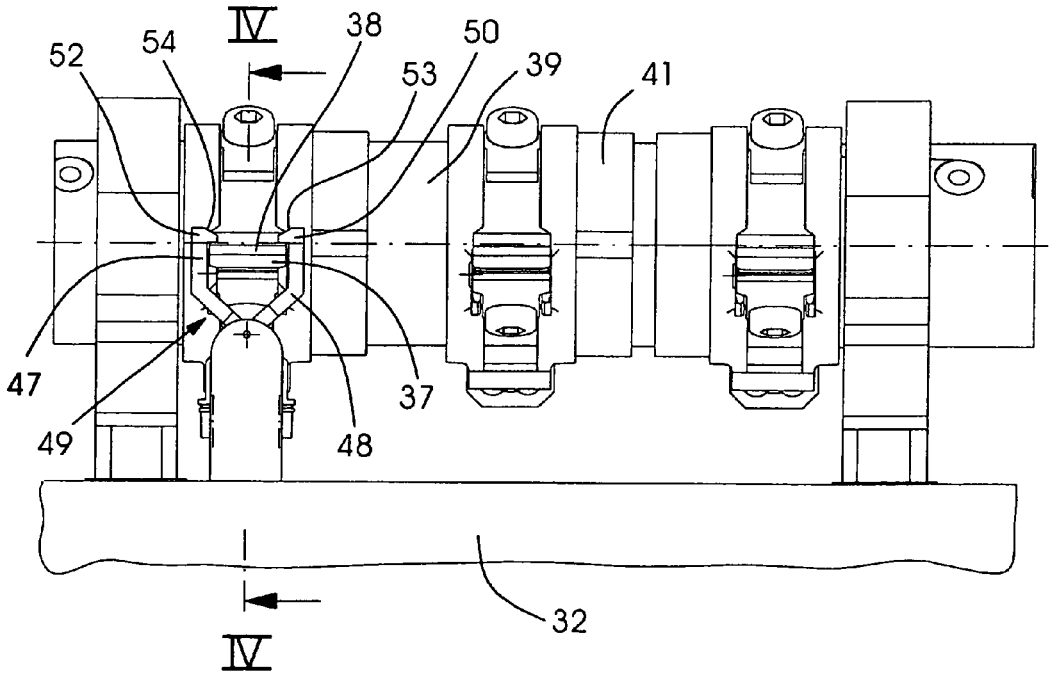
FIG. 5 is a plan view showing the second exemplary embodiment.

In a second exemplary embodiment according to FIGS. 4, 5, provision is made to lock the grippers 37, 38 directly during the sheet transport in recto printing operation, the locking being carried out under control. To this end, provision is made to mount locking tongs 49 having two flexible locking arms 47, 48 on the cylinder body of the turner drum 32 in the axial direction of the turner drum 32. The locking arms 47, 48 each have at their ends a hook-like holder 50, 52 which, in the locked state, acts on the rigid gripper 38 so that upper and lower gripper 38, 37 are held together during the sheet transport in recto printing operation. For the purpose of unlocking, the lower gripper 37—also designated a sprung gripper—is controlled downward, preferably by means of the contour of a control cam to such an extent that, via the locking arms or tongs limbs 47, 48 running obliquely, it pivots the latter away from each other until opening of the tongs 49 allows the rigid gripper 38 to leave the closing range of the tongs 45. The sprung gripper 37 is of narrower design than the spacing of the hooks 52 of the locking arms 47, 48, so that the latter can enter and leave the locking range of the tongs 49 without hindrance. The entry of the rigid gripper 38 on the upper side of the locking arms 47, 48 on the hook 50, 52 is also made possible by bevels 53, 54 made thereon. As a result of the contact with the rigid gripper 38, the locking arms 47, 48 are forced apart by means of the bevels 53, 54, counter to a spring force, until the rigid gripper 38 dips underneath the hook 52 into the locking range of the tongs 49.

Figure 6:
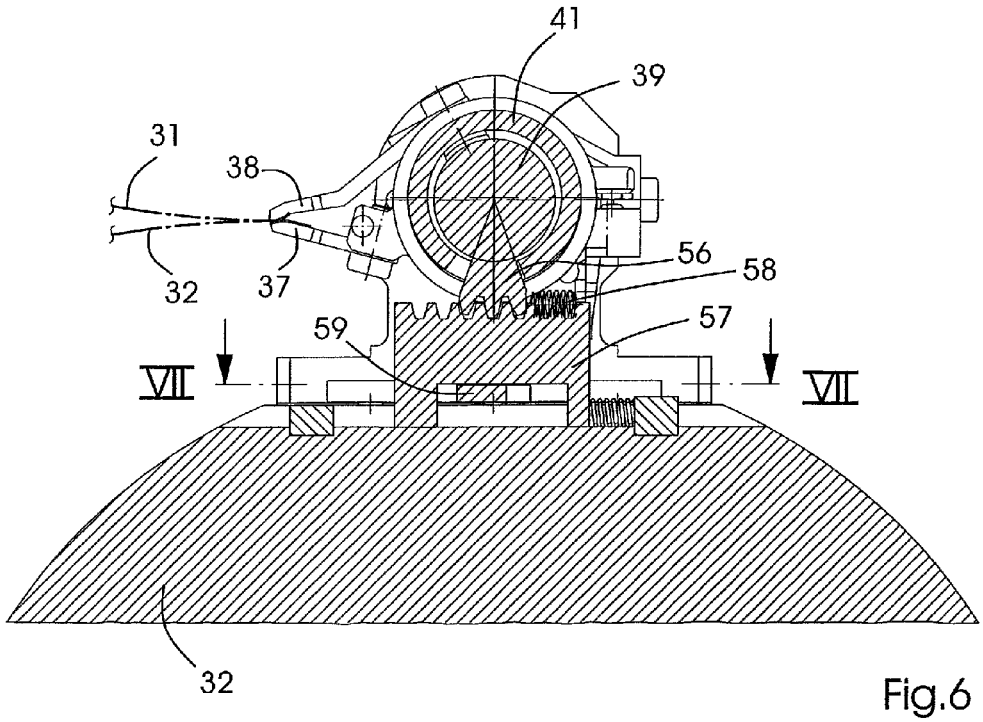
FIG. 6 is a schematic sectional view of a third exemplary embodiment of a locking device, taken along the section line VI-VI in FIG. 8.
Figure 7:
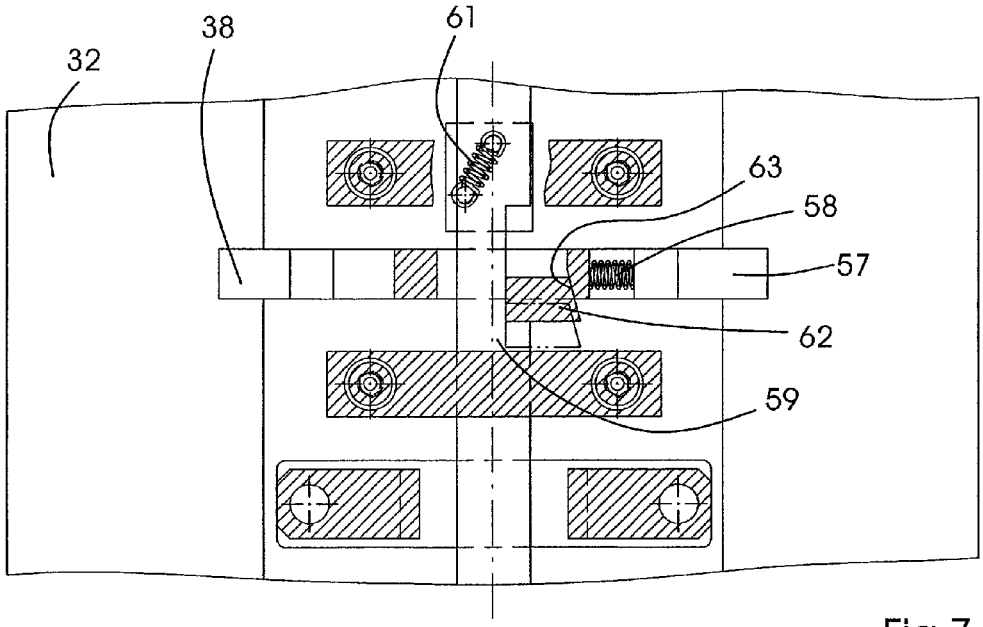
FIG. 7 is a plan view onto a section, taken along the section line VII-VII in FIG. 6, through the third exemplary embodiment.
Figure 8:
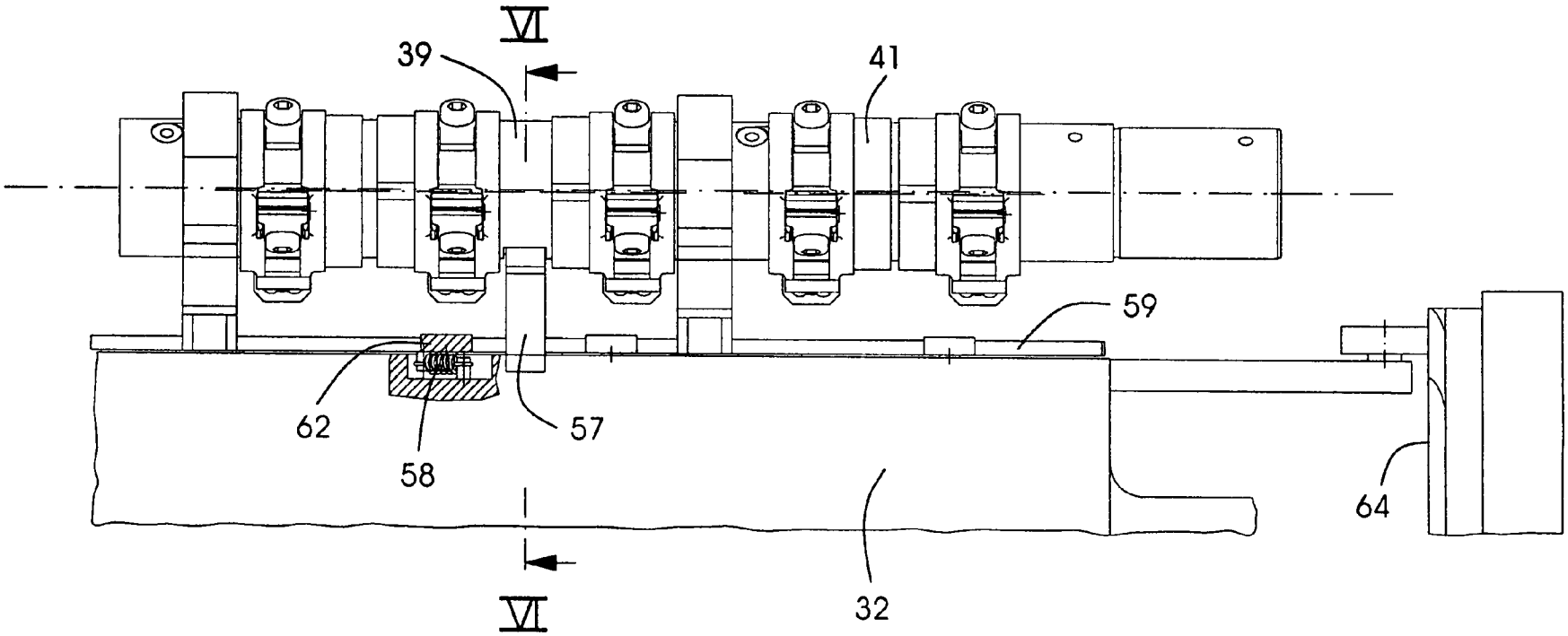
FIG. 8 is a plan view onto the device according to the invention shown in FIG. 6.

In a third exemplary embodiment according to FIGS. 6, 7, the gripper shaft 39 has a toothed segment 56, which is in engagement with a rack 57. The rack 57 is mounted such that it can be displaced in the circumferential direction of the turner drum 32 counter to a compression spring 58. A wedge bar 59 mounted such that it can be displaced in the axial direction acts on the rack 57 and is used to fix the rack 57 and thus also to fix the gripper shaft 39 in engagement with the rack 57 during recto printing operation. The wedge connection can be provided on a single gripper system, on a plurality of selected gripper systems or on all the gripper systems.

During pivoting movement of the rigid gripper 38, the toothed segment 56 moves into the rack 57 and, as a result of the incline of a wedge-shaped part 62, moves it against the spring 58. At the closing point of the rigid gripper 38, the wedge bar 59 is moved against a spring 61 by an axial cam 64. In the process, the wedge-shaped part 62 of the wedge bar 59 moves against the stop 63, likewise formed in a wedge shape at this point, of the rack 57. The rack 57 and thus also the gripper shaft 39 connected to it via the toothing are locked. Shortly before the opening of the tongs grippers 39, the blocking of the rack 57 is canceled again by the wedge-shaped part 62 of the wedge bar 59 being forced out of the range of the rack 57 under the control of an axial cam 64. The gripper shaft 39 is then able to execute rotational movements again.

This application claims the priority, under 35 U.S.C. § 119, of German patent application No. 10 2005 010 426.6, filed Mar. 8, 2005; the disclosure of the prior application is herewith incorporated by reference in its entirety.

We claim:

1. A device for transporting sheets in a sheet-processing machine having a turner drum, comprising:

a tongs gripper system configured to selectively transport sheets in recto printing operation or in turning operation, said gripper system having a plurality of grippers each with an upper gripper and a lower gripper said tongs grippers being supported on the turner drum of the sheet-processing press;

wherein said upper gripper is configured to form a gripper pad in recto printing operation, and said upper gripper is disposed to be locked at the turner drum in recto printing operation.

2. The device according to claim 1, which comprises a gripper shaft and said upper gripper is indirectly lockable via said gripper shaft.

3. The device according to claim 1, which comprises locking means for locking said upper gripper during the recto printing operation.

4. The device according to claim 3, wherein said locking means is a support fixed to the turner drum and disposed to interact with a sprung locking means.

5. The device according to claim 3, wherein said locking means is a toothed segment disposed to interact with a displaceable rack fixed mounted to the turner drum.

6. The device according to claim 5, which comprises a controlled wedge bar for blocking said rack.

7. The device according to claim 1, wherein said upper gripper and said lower gripper are disposed to be locked.

8. The device according to claim 7, which comprises locking means for indirectly locking said upper and lower grippers.

9. The device according to claim 8, wherein said locking means has locking tongs supported firmly on the turner drum, and said locking tongs engage around upper and lower grippers.

10. The device according to claim 1, which comprises locking means assigned to at least one pair of tongs grippers.

11. The device according to claim 1, which comprises locking means assigned to selected pairs of tongs grippers.

12. The device according to claim 1, which comprises locking means respectively assigned to each pair of tongs grippers.

* * * * *